United States Patent [19]

Swan et al.

[11] Patent Number: 4,904,407

[45] Date of Patent: Feb. 27, 1990

[54] AZEOTROPE-LIKE COMPOSITIONS OF 1,1,2-TRICHLORO-1,2,2-TRIFLUOROETHANE, METHANOL, NITROMETHANE, 1,2-DICHLOROETHYLENE AND 1-CHLOROPROPANE

[75] Inventors: Ellen L. Swan, Ransomville; Rajat S. Basu; David P. Wilson, both of Williamsville; Earl A. E. Lund, West Seneca, all of N.Y.

[73] Assignee: Allied-Signal Inc., Morristown, N.J.

[21] Appl. No.: 278,404

[22] Filed: Dec. 1, 1988

[51] Int. Cl.[4] ..... C11D 7/50; C11D 7/30

[52] U.S. Cl. ..... 252/171; 134/12; 134/38; 134/39; 134/40; 252/162; 252/170; 252/172; 252/364; 252/DIG. 9

[58] Field of Search ..... 252/162, 170, 171, 172, 252/364, DIG. 9; 134/12, 38, 39, 40

[56] References Cited

U.S. PATENT DOCUMENTS

| | | | |
|---|---|---|---|
| 2,999,816 | 9/1961 | Bennett et al. | 252/171 |
| 3,085,918 | 4/1963 | Sherliker et al. | 134/30 |
| 3,573,213 | 3/1971 | Burt | 252/172 |
| 3,960,746 | 6/1976 | Gorski | 252/171 |
| 4,767,561 | 8/1988 | Gorski | 252/171 |

*Primary Examiner*—Paul Lieberman
*Assistant Examiner*—Kathleen Markowski
*Attorney, Agent, or Firm*—Jay P. Friedenson

[57] ABSTRACT

Azeotrope-like compositions comprising 1,1,2-trichloro-1,2,2-trifluoroethane, methanol, nitromethane, 1,2-dichloroethylene and 1-chloropropane are stable and have utility as degreasing agents and as solvents in a variety of industrial cleaning applications including the defluxing of printed circuit boards.

21 Claims, No Drawings

AZEOTROPE-LIKE COMPOSITIONS OF 1,1,2-TRICHLORO-1,2,2-TRIFLUOROETHANE, METHANOL, NITROMETHANE, 1,2-DICHLOROETHYLENE AND 1-CHLOROPROPANE

FIELD OF THE INVENTION

This invention relates to azeotrope-like mixtures of 1,1,2-trichloro-1,2,2-trifluoroethane, methanol, nitromethane, 1,2-dichloroethylene and 1-chloropropane. These mixtures are useful in a variety of vapor degreasing applications and as solvents in a variety of industrial cleaning applications including defluxing of printed circuit boards.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions including the desired fluorocarbon components such as trichlorotrifluoroethane which include components which contribute additionally desired characteristics, such as polar functionality, increased solvency power, and stabilizers. Azeotropic compositions are desired because they exhibit a minimum boiling point and do not fractionate upon boiling. This is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not azeotrope or azeotrope-like, would result in mixtures with changed compositions which may have less desirable properties, such as lower solvency towards soils, less inertness towards metal, plastic or elastomer components, and increased flammability and toxicity.

A number of 1,1,2-trichloro-1,2,2-trifluoroethane based azeotrope compositions have been discovered which have been tested and in some cases employed as solvents for miscellaneous vapor degreasing and defluxing applications. For example, U.S. Pat. No. 3,573,213 discloses the azeotrope of 1,1,2-trichloro-1,2,2-trifluoroethane and nitromethane; U.S. Pat. No. 2,999,816 discloses an azeotropic composition of 1,1,2-trichloro-1,2,2-trifluoroethane and methyl alcohol; U.S. Pat. No. 3,960,746 discloses azeotrope-like compositions of 1,1,2-trichloro-1,2,2-trifluoroethane, methanol and nitromethane. U.S. Pat. No. 3,455,835 discloses azeotrope-like compositions of 1,1,2-trichloro-1,2,2-trifluoroethane and and trans-1,2-dichloroethylene. U.S. Pat. No. 4,767,561 discloses azeotrope-like compositions containing 1,1,2-trichloro-1,2,2-trifluoroethane, methanol and trans-1,2-dichloroethylene.

The art is continually seeking new fluorocarbon based azeotropic mixtures or azeotrope-like mixtures which offer alternatives for new and special applications for vapor degreasing and other cleaning applications.

It is accordingly an object of this invention to provide novel azeotrope-like compositions based on 1,1,2-trichloro-1,2,2-trifluoroethane which have good solvency power and other desirable properties for vapor degreasing and other solvent cleaning applications.

Another object of the invention is to provide novel constant boiling or essentially constant boiling solvents which are liquid at room temperature, will not fractionate under conditions of use and also have the foregoing advantages.

A further object is to provide azeotrope-like compositions which are nonflammable both in the liquid phase and the vapor phase. These and other objects and features of the invention will become more evident from the description which follows.

DESCRIPTION OF THE INVENTION

In accordance with the invention, novel azeotrope-like compositions have been discovered comprising 1,1,2-trichloro-1,2,2-trifluoroethane, methanol, nitromethane, 1,2-dichloroethylene and 1-chloropropane.

1,2-Dichloroethylene exists in two isomeric forms, the trans-1,2-dichloroethylene and the cis-1,2-dichloroethylene. Each isomer forms azeotrope-like mixtures with 1,1,2-trichloro-1,2,2-trifluoroethane, methanol and nitromethane in accordance with the invention, as well as do mixtures of the trans- and cis-isomers. For example, trans-1,2-dichloroethylene is often provided as a mixture with up to about 5 weight percent cis-1,2-dichloroethylene.

The trans-isomer is the preferred 1,2-dichloroethylene isomer in accordance with the invention.

With respect to the preferred trans-1,2-dichloroethylene embodiment of the invention, the azeotrope-like compositions comprise from about 51.9 to about 62.8 weight percent of 1,1,2-trichloro-1,2,2-trifluoroethane, from about 5.7 to about 6.2 weight percent of methanol, from about 0.05 to about 0.3 weight percent of nitromethane, from about 10.0 to about 19.5 weight percent of 1-chloropropane and from about 16.3 to about 24.3 weight percent of trans-1,2-dichloroethylene.

Still preferably, such azeotrope-like compositions containing the trans-isomer of 1,2-dichloroethylene comprise from about 58.4 to about 62.8 weight percent of 1,1,2-trichloro-1,2,2-trifluoroethane, from about 6.0 to about 6.2 weight percent of methanol, from about 0.05 to about 0.3 weight percent of nitromethane, from about 15.5 to about 10.5 weight percent of 1-chloropropane and from about 17.3 to about 19.8 weight percent trans-1,2-dichloroethylene.

The most preferred azeotrope-like composition containing the trans-isomer of 1,2-dichloroethylene consists essentially of about 64.7 weight percent of 1,1,2-trichloro-1,2,2-trifluoroethane, about 6.1 weight percent of methanol, about 0.2 weight percent of nitromethane, about 13.6 weight percent of 1-chloropropane and about 17.9 weight percent trans-1,2-dichloroethylene. This composition boils at about 38° C. at 760 mm Hg.

With respect to the cis-1,2-dichloroethylene embodiment of the invention, the azeotrope-like compositions comprise from about 70.4 to about 72.0 weight percent of 1,1,2-trichloro-1,2,2-trifluoroethane, from about 5.8 to about 6.3 weight percent of methanol, from about 0.03 to about 0.5 weight percent of nitromethane, from about 20.0 to about 22.0 weight percent of 1-chloropropane and from about 2.0 to about 0.4 weight percent of cis-1,2-dichloroethylene.

Still preferably, such azeotrope-like compositions comprise from about 70.4 to about 71.3 weight percent of 1,1,2-trichloro-1,2,2-trifluoroethane, from about 6.1 to about 6.3 weight percent of methanol, from about 0.03 to about 0.2 weight percent of nitromethane, from about 21.2 to about 21.6 weight percent of 1-chloropropane and from about 2.0 to about 0.8 weight percent of cis-1,2-dichloroethylene.

The most preferred azeotrope-like composition containing the cis-isomer of 1,2-dichloroethylene consists essentially of about 71.3 weight percent of 1,1,2-trichloro-1,2,2-trifluoroethane, about 6.3 weight percent of methanol, about 0.2 weight percent of nitromethane, about 21.6 weight percent of 1-chloropropane and about 0.8 weight percent cis-1,2-dichloroethylene. This composition boils at about 38.5° C. at 760 mm Hg.

With respect to the embodiment of the invention containing a mixture of the cis and trans isomers of 1,2-dichloroethylene, the azeotrope-like compositions comprise from about 51.9 to about 65.5 weight percent of 1,1,2-trichloro-1,2,2-trifluoroethane, from about 5.7 to about 6.3 weight percent of methanol, from about 0.02 to about 0.5 weight percent of nitromethane, from about 10.0 to about 22.0 weight percent of 1-chloropropane, from about 16.3 to about 24.3 weight percent of trans-1,2-dichloroethylene and from about 2.0 to about 0.4 weight percent of cis-1,2-dichloroethylene.

Still preferably, such azeotrope-like compositions comprise from about 58.4 to about 65.5 weight percent of 1,1,2-trichloro-1,2,2-trifluoroethane, from about 6.0 to about 6.3 weight percent of methanol, from about 0.02 to about 0.2 weight percent of nitromethane, from about 15.5 to about 10.5 weight percent of 1-chloropropane, from about 16.0 to about 18.0 weight percent of trans-1,2-dichloroethylene and from about 2.0 to about 0.5 weight percent of cis-1,2-dichloroethylene.

The most preferred azeotrope-like composition containing the cis- and trans-isomers of 1,2-dichloroethylene consists essentially of about 65.5 weight percent of 1,1,2-trichloro-1,2,2-trifluoroethane, about 6.1 weight percent of methanol, about 0.2 weight percent of nitromethane, about 10.8 weight percent of 1-chloropropane, about 16.8 weight percent of trans-1,2-dichloroethylene and about 0.7 weight percent of cis-1,2-dichloroethylene. This composition boils at about 39.2° C. at 760 mm Hg.

The precise azeotrope compositions in accordance with the invention have not been determined but have been ascertained to be within the above ranges. Regardless of where the true azeotrope lie, all compositions within the indicated ranges, as well as certain compositions outside the indicated ranges, are azeotrope-like, as defined more particularly below.

It has been found that these azeotrope-like compositions are stable, safe to use and that the preferred compositions of the invention are nonflammable (exhibit no flash point when tested by the Tag Open Cup test method—ASTM D 1310-86) and exhibit excellent solvency power. These compositions have been found to be particularly effective when employed in conventional degreasing units for the dissolution of rosin fluxes and the cleaning of such fluxes from printed circuit boards.

From fundamental principles, the thermodynamic state of a system (pure fluid or mixture) is defined by four variables: pressure, temperature, liquid compositions and vapor compositions, or P-T-X-Y, respectively. An azeotrope is a unique characteristic of a system of two or more components where X and Y are equal at the stated P and T. In practice, this means that the components of a mixture cannot be separated during distillation or in vapor phase solvent cleaning when that distillation is carried out at a fixed T (the boiling point of the mixture) and a fixed P (atmospheric pressure).

For the purpose of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, in order to determine whether a candidate mixture is "azeotrope-like" within the meaning of this invention, one only has to distill a sample thereof under conditions (i.e. resolution—number of plates) which would be expected to separate the mixture into its separate components. If the mixture is non-azeotropic or non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at differing pressures, the composition of a given azeotrope will vary at least slightly and changes in distillation pressures also change, at least slightly, the distillation temperatures. Thus, an azeotrope of A and B represents a unique type of relationship but with a variable composition depending on temperature and/or pressure. Accordingly, another way of defining azeotrope-like within the meaning of this invention is to state that such mixtures boil within ±1° C. of the boiling point of the most preferred compositions disclosed herein (i.e. within ±1° C. of the 38.0° C./760 mm Hg boiling point of the azeotrope-like compositions containing at least 16.3 weight percent trans-1,2-dichloroethylene; within ±1° C. of the 38.5° C./760 mm Hg. boiling point of the azeotrope-like compositions containing at least 0.4 weight percent cis-1,2-dichloroethylene isomer and within ±1° C. of the 39.2° C./760 mm Hg boiling point of the azeotrope-like compositions containing a mixture of at least 16.3 weight percent trans- and at least 0.4 weight percent cis-1,2-dichloroethylene).

The 1,1,2-trichloro-1,2,2-trifluoroethane, methanol, nitromethane, 1,2-dichloroethylene and 1-chloropropane components of the novel solvent azeotrope-like compositions of the invention are all commercially available. Preferably they should be used in sufficiently high purity so as to avoid the introduction of adverse influences upon the solvency properties or constant boiling properties of the system. A suitable grade of 1,1,2-trichloro-1,2,2-trifluoroethane, for example, is sold by Allied-Signal Inc. under the trademark GENESOLV ® D.

EXAMPLES 1-4

The azeotrope-like compositions of the invention were determined through the use of distillation techniques designed to provide higher rectification of the distillate than found in most vapor degreaser systems. For this purpose a five theoretical plate Oldershaw distillation column was used with a cold water condensed, automatic liquid dividing head. Typically, approximately 350 grams of liquid were charged to the distillation pot. The liquid was a mixture comprised of various combinations of 1,1,2-trichloro-1,2,2-trifluoroethane, methanol, nitromethane, 1-chloropropane, cis-1,2-dichloroethylene and trans-1,2-dichloroethylene. The mixtures were heated at total reflux for about one hour to ensure equilibration. For most of the runs, the distillate was obtained using a 3:1 reflux ratio at a boil-up rate of 250–300 grams per hour. Approximately 150 grams of product were distilled and 4 approximately equivalent sized overhead cuts were collected. The vapor temperature (of the distillate), pot temperature, and barometric pressure were monitored. A constant boiling fraction was collected and analyzed by gas chromatography to determine the weight percentages of its components.

To normalize observed boiling points during different days to 760 mm of mercury pressure, the approximate normal boiling points of 1,1,2-trichloro-1,2,2-trifluoroethane rich mixtures were estimated by applying a barometric correction factor of about 26 mm Hg/°C., to the observed values. However, it is to be noted that this corrected boiling point is generally accurate up to ±0.4° C. and serves only as a rough comparison of boiling points determined on different days. By the above-described method, it was discovered that constant boiling mixtures were formed as indicated in the following Table. Supporting distillation data for the mixtures studied are shown in the Table.

TABLE

| Example (Distillation) | Starting Material (wt. %) FC-113 | MeOH | TDCE | 1-CP | NM | CDCE |
|---|---|---|---|---|---|---|
| 1 | 51.9 | 5.7 | 24.3 | 18.0 | 0.3 | — |
| 2 | 59.0 | 5.8 | 20.0 | 15.0 | 0.2 | — |
| 3 | 70.4 | 6.1 | — | 21.2 | 0.2 | 2.0 |
| 4 | 62.5 | 6.2 | 18.0 | 11.1 | 0.2 | 2.0 |

| Example (Distillation) | Distillate (wt. %) FC-113 | MeOH | TDCE | 1-CP | NM | CDCE |
|---|---|---|---|---|---|---|
| 1 | 58.4 | 6.2 | 19.8 | 15.5 | 0.06 | — |
| 2 | 62.8 | 6.2 | 17.3 | 13.6 | 0.02 | — |
| 3 | 71.3 | 6.3 | — | 21.6 | 0.03 | 0.7 |
| 4 | 65.5 | 6.1 | 16.8 | 10.8 | 0.03 | 0.7 |

| (Distillation) | Boiling Point (°C.) | Barometric Pressure (mm Hg) | Boiling Point Corrected to 760 mm Hg |
|---|---|---|---|
| 1 | 37.8 | 748.0 | 38.1 |
| 2 | 36.9 | 734.0 | 37.9 |
| | | | Mean 38.0° C. ± 0.1 |
| 3 | 37.5 | 735.0 | 38.5 |
| 4 | 38.2 | 735.0 | 39.2 |

FC-113 = 1,1,2-trichloro-1,2,2-trifluoroethane
MeOH = methanol
TDCE = trans-1,2-dichloroethylene
1-CP = 1-chloropropane
NM = nitromethane
CDCE = cis-1,2-dichloroethylene From the above examples, it is readily apparent that additional constant boiling or essentially constant boiling mixtures of the same components can readily be identified by anyone of ordinary skill in this art by the method described. No attempt was made to fully characterize and define the true azeotrope in the systems described above, nor the outer limits of the compositional ranges which are constant boiling. Anyone skilled in the art can readily ascertain other constant boiling or essentially constant boiling mixtures.

What is claimed is:

1. Azeotrope-like compositions consisting essentially of from about 51.9 to about 62.8 weight percent 1,1,2-trichloro-1,2,2-trifluoroethane, from about 5.7 to about 6.2 weight percent methanol, from about 0.05 to about 0.3 weight percent nitromethane, from about 16.3 to about 24.3 weight percent trans-1,2-dichloroethylene and from about 10.0 to about 19.5 weight percent 1-chloropropane.

2. Azeotrope-like compositions according to claim 1 wherein said weight percent of 1,1,2-trichloro-1,2,2-trifluoroethane is from about 58.4 to about 62.8, said weight percent of methanol is from about 6.0 to about 6.2, said weight percent of nitromethane is from about 0.3 to about 0.05, said weight percent of trans-1,2-dichloroethylene is from about 17.3 to about 19.8 and said weight percent of 1-chloropropane is from about 10.5 to about 15.5.

3. Azeotrope-like compositions according to claim 1 wherein said weight percent of 1,1,2-trichloro-1,2,2-trifluoroethane is about 64.7, said weight percent of methanol is about 6.1, said weight percent of nitromethane is about 0.2, said weight percent of trans-1,2-dichloroethylene is about 17.9 and said weight percent of 1-chloropropane is about 13.6, which compositions have a boiling point of about 38° C. at 760 mm Hg.

4. Azeotrope-like compositions consisting essentially of from about 70.4 to about 72.0 weight percent 1,1,2-trichloro-1,2,2-trifluoroethane, from about 5.8 to about 6.3 weight percent methanol, from about 0.03 to about 0.5 weight percent nitromethane, from about 2.0 to about 0.4 weight percent cis-1,2-dichloroethylene and 20.0 to about 22.0 weight percent 1-chloropropane.

5. Azeotrope-like compositions according to claim 4 wherein said weight percent of 1,1,2-trichloro-1,2,2-trifluoroethane is from about 70.4 to about 71.3, said weight percent of methanol is from about 6.1 to about 6.3, said weight percent of nitromethane is from about 0.03 to about 0.2, said weight percent of cis-1,2-dichloroethylene is from about 2.0 to about 0.8 and said weight percent of 1-chloropropane is from about 21.2 to about 21.6.

6. Azeotrope-like compositions according to claim 4 wherein said weight percent of 1,1,2-trichloro-1,2,2-trifluoroethane is about 71.3, said weight percent of methanol is about 6.3, said weight percent of nitromethane is about 0.2, said weight percent of cis-1,2-dichloroethylene is about 0.8 and said weight percent of 1-chloropropane is about 21.6, which compositions have a boiling point of about 38.5° C. at 760 mm Hg.

7. Azeotrope-like compositions consisting essentially of from about 51.9 to about 65.5 weight percent 1,1,2-trichloro-1,2,2-trifluoroethane, from about 5.7 to about 6.3 weight percent methanol, from about 0.02 to about 0.5 weight percent nitromethane, from about 16.3 to about 24.3 weight percent trans-1,2-dichloroethylene, from about 2.0 to about 0.4 weight percent cis-1,2-dichloroethylene and from about 10.0 to about 22.0 weight percent 1-chloropropane.

8. Azeotrope-like compositions according to claim 7 wherein said weight percent of 1,1,2-trichloro-1,2,2-trifluoroethane is from about 58.4 to about 65.5, said weight percent of methanol is from about 6.0 to about 6.3, said weight percent of nitromethane is from about 0.02 to about 0.2, said weight percent of trans-1,2-dichloroethylene is from about 16.0 to about 18.0, said weight percent of cis-1,2-dichloroethylene is from about 2.0 to about 0.5 and said weight percent of 1-chloropropane is from about 15.5 to about 10.5.

9. Azeotrope-like compositions according to claim 7 wherein said weight percent of 1,1,2-trichloro-1,2,2-trifluoroethane is about 65.5, said weight percent of methanol is about 6.1, said weight percent of nitromethane is about 0.2, said weight percent of trans-1,2-dichloroethylene is about 16.8, said weight percent of cis-1,2-dichloroethylene is about 0.7 and said weight percent of 1-chloropropane is about 10.8, which compositions have a boiling point of about 39.2° C. at 760 mm Hg.

10. Azeotrope-like compositions consisting essentially of 1,1,2-trichloro-1,2,2-trifluoroethane, methanol, nitromethane, at least about 16.3 weight percent trans-1,2-dichloroethylene and at least about 10.0 weight percent 1-chloropropane which boil at about 38° C.±1° C. at 760 mm Hg.

11. Azeotrope-like compositions consisting essentially of 1,1,2-trichloro-1,2,2-trifluoroethane, methanol, nitromethane, at least about 0.4 weight percent cis-1,2-dichloroethylene and at least about 20.0 weight percent 1-chloropropane which boil at about 38.5° C.±1° C. at 760 mm Hg.

12. Azeotrope-like compositions consisting essentially of 1,1,2-trichloro-1,2,2-trifluoroethane, methanol, nitromethane, at least about 10 weight percent 1-chloropropane and a mixture of at least about 16.3 weight percent trans-1,2-dichloroethylene and at least about 0.4 weight percent cis-1,2-dichloroethylene which boil at about 39.2° C.±1° C. at 760 mm Hg.

13. The method of cleaning a solid surface which comprises treating said surface with an azeotrope-like composition as defined in claim 1.

14. The method of cleaning a solid surface which comprises treating said surface with an azeotrope-like composition as defined in claim 4.

15. The method of cleaning a solid surface which comprises treating said surface with an azeotrope-like composition as defined in claim 6.

16. The method of cleaning a solid surface which comprises treating said surface with an azeotrope-like composition as defined in claim 10.

17. The method of cleaning a solid surface according to claim 16 in which the solid surface is a printed circuit board contaminated with solder flux.

18. The method of cleaning a solid surface which comprises treating said surface with an azeotrope-like composition as defined in claim 11.

19. The method of cleaning a solid surface according to claim 18 in which the solid surface is a printed circuit board contaminated with solder flux.

20. The method of cleaning a solid surface which comprises treating said surface with an azeotrope-like composition as defined in claim 12.

21. The method of cleaning a solid surface according to claim 20 in which the solid surface is a printed circuit board contaminated with solder flux.

* * * * *